US006068665A

United States Patent [19]

Calton et al.

[11] Patent Number: 6,068,665

[45] Date of Patent: May 30, 2000

[54] STAIN REMOVING COMPOSITIONS

[75] Inventors: Gary J. Calton, Elkridge, Md.; John B. Cook, Phoenixville, Pa.

[73] Assignee: OdorPro, Inc., Elkridge, Md.

[21] Appl. No.: 09/317,567

[22] Filed: May 24, 1999

[51] Int. Cl.[7] ..... C11D 17/06; D06L 1/04

[52] U.S. Cl. ..... 8/137; 8/142; 510/278; 510/281; 510/282

[58] Field of Search ..... 510/278–282; 8/137, 142

[56] References Cited

U.S. PATENT DOCUMENTS 4,493,781 1/1985 Chapman et al. .
5,286,400 2/1994 Paszek et al. .
5,374,370 12/1994 Brown et al. .
5,616,547 4/1997 Ponce et al. .
5,736,494 4/1998 Coluriciello et al. .

*Primary Examiner*—Margaret Einsmann
*Attorney, Agent, or Firm*—Beverly J. Artale

[57] ABSTRACT

An improved method for the removal of stains from textiles is disclosed. The method involves the use of novel mixtures of zeolites and imides. The method of the invention provides superior performance in the removal of stains, especially those from animal wastes or fluids. The zeolite/imide mixtures are useful to remove stains from various textile fabrics and fibers, e.g. carpets, clothing, and upholstered goods.

20 Claims, No Drawings

STAIN REMOVING COMPOSITIONS

FIELD OF THE INVENTION

This invention relates to a method of using novel zeolite/imide compositions for the removal of stains from textile fabrics or fibers.

BACKGROUND OF THE INVENTION

Zeolites have been used in carpet cleaners for their value as absorbents. For example, U.S. Pat. No. 5,736,494 discloses powder carpet cleaning compositions containing zeolites without the addition of boric acid or borax. U.S. Pat. No. 4,493,781 describes a carpet cleaning composition having a significant proportion of one or more zeolite constituent. U.S. Pat. No. 5,286,400 discloses carpet cleaning compositions containing zeolites, borax, and powdered cellulose adsorbents.

Other various and sundry stain removal compositions are available to clean fabrics. However, there remains a need in the art for improved cleaning compositions having an increased ability to eliminate odors and removal stains from textile fabrics or fibers, especially those stains associated with animal fluids and wastes.

Accordingly, it is an advantage of the invention to provide novel zeolite/imide compositions useful for the removal of stains from textile fabrics or fibers.

It is also an advantage of the invention to provide improved stain removal compositions having a high affinity for the removal of stains associated with animal fluid and waste stains from textile fabrics or fibers.

It is a further advantage of the invention to provide an improved process for the removal of stains from textile fabrics or fibers.

These and other advantages of the present invention are described in more details below.

SUMMARY OF THE INVENTION

It has now been surprisingly discovered that a mixture of zeolites and imides gives superior performance to remove stains from textile fibers and fabrics. Zeolite/imide compositions in accordance with the invention are especially effective to remove stains resulting from animal fluids and wastes. In general, stain removal is accomplished by contacting a stained fibrous textile at the locus of the stain with an effective stain removing amount of the zeolite/imide composition for a period of time sufficient to allow removal of the stain.

DETAILED DESCRIPTION OF THE EMBODIMENTS

Stain removal compositions useful in the present invention comprise a mixture a least one zeolite and at least one imide. The zeolite and imide components are present in the mixture in an amount sufficient to remove stains from a fibrous textile. In general, the ratio of zeolite to imide present in the mixture ranges from about 1:1 to about 99.9:0.1.

Zeolites useful to prepare mixtures in accordance with the present invention include naturally occurring or synthetic zeolites. Zeolites, whether natural or synthetic, are characterized by an aluminosilicate tetrahedral framework, and have ion exchangeable large cations and loosely held water molecules permitting reversible dehydration. The general formula for a zeolite is as follows: $MO.Al2O_3.nSiO_2.xH_2O$, where M is Na, K, Ca, Sr or Ba and n and x are integers.

The oxygen atoms in the framework of the zeolite are each shared by two tetrahedrons, thus, the (Si, Al):O ratio is exactly 1:2. The amount of large cations present is dependent on the aluminum to silicon ratio and the formal charge of these large cations. The large cations, which are coordinated by framework oxygens and water molecules, reside in large cavities in the crystal structure. These cavities and channels may even permit the selective passage of organic molecules.

A partial listing of natural zeolites is given in Table 1.

TABLE 1

| Group | Name | Formula |
|---|---|---|
| Analcime | Analcime | $Na(Al_{16}Si_{32}O_{96}).16H_2O$ |
| | Wairakite | $Ca_{16}(Al_{16}Si_{32}O_{96}).16H_2O$ |
| | Pollucite | $Cs_{32}(Al_{16}Si_{32}O_{96}).16H_2O$ |
| Sodalite | Sodalite | $Na_6(Al_6Si_6O_{24})2NaCl$ |
| | Faujasite | $(Na_2,Ca,Mg)_{29}((Al_{58}Si_{134}O_{384}).240H_2O$ |
| Chabazite | Chabazite | $Ca_6(Al_{12}Si_{24}O_{72}).40H_2O$ |
| | Gmelinite | $(Na_2,Ca)_4[Al_8Si_{16}O_{48}).24H_2O$ |
| | Erionite | $(Na_2,Ca)_{3.5}K_2[Al_9Si_{27}O_{72}).27H_2O$ |
| | Offretite | $(Ca,Mg)_{1.5}K[Al_4Si_{14}O_{36}].14H_2O$ |
| | Levyne | $Ca_9(Al_{18}Si_{36}O_{108}).50H_2O$ |
| Natrolite | Natrolite | $Na_{16}(Al_{16}Si_{24}O_{80}).16H_2O$ |
| | Scolecite | $Ca_{16}(Al_{16}Si_{24}O_{80}).16H_2O$ |
| | Mesolite | $Na_{16}Ca_{16}(Al_{16}Si_{24}O_{80}).64H_2O$ |
| | Edingtonite | $Ba_2(Al_4Si_6O_{20}).8H_2O$ |
| | Thomsonite | $Na_4Ca_8(Al_{20}Si_{20}O_{80}).24H_2O$ |
| | Gonnardite | $Na_{6.42},K_{0.01},Ca_{1.5}Al_{9.22}0Si_{110.43}O_{40}.12.37 H_2O$ |
| Phillipsite | Phillipsite | $K_2(Ca,Na_2)_2(Al_6Si_{10}O_{32}).12H_2O$ |
| | Harmontome | $Ba_2(Al_4Si_{12}O32).12H_2O$ |
| | Gismondine | $Ca_4(Al_8Si_8O_{32}).16H_2O$ |
| | Garronite | $(NaCa_2)_5(Al_6Si_{10}O_{32}).13H_2O$ |
| Mordenite | Mordenite | $Na_8(Al_8Si_{40}O_{96}).24H_2O$ |
| | Diachiardite | $Na_5(Al_5Si_{19}O_{48}).12H_2O$ |
| Other | Clinoptilolite | $Na_6(Al_6Si_{30}O_{72}).72H_2O$ |
| | Heulandite | $Ca_4(Al_8Si_{28}O_{72}).24H_2O$ |
| | Brewsterite | $(Sr,Ba)_2(Al_4Si_{12}O_{32}).10H_2O$ |
| | Epistilbite | $Ca_3(Al_6Si_{18}O_{48}).16H_2O$ |
| | Stilbite | $Na_4Ca_8(Al_{20}Si_{52}O_{144}).56H_2O$ |
| | Yugawaralite | $Ca_2(Al_4Si_{12}O_{32}).8H_2O$ |
| | Laumontite | $Ca_4(Al_8Si_{16}O_{48}).16H_2O$ |
| | Ferrierite | $Na_2Mg_2(Al_6Si_{30}O_{72}).18H_2O$ |
| | Paulingite | $(K_2,Ca,Na_2)_{76}[Al_{152}Si_{520}O_{1344}]\sim 7H_2O$ |

Prior art techniques have resulted in the formation of a great variety of synthetic zeolites. These zeolites have come to be designated by letter or other convenient symbols, as illustrated by zeolite A (U.S. Pat. No. 2,882,243), zeolite X (U.S. Pat. No. 2,882,244), zeolite Y (U.S. Pat. No. 3,130,007), zeolite ZK-5 (U.S. Pat. No. 3,247,195), zeolite ZK-4 (U.S. Pat. No. 3,314,752), zeolite ZSM-5 (U.S. Pat. No. 3,702,886), zeolite ZSM-11 (U.S. Pat. No. 3,709,979), zeolite ZSM-12 (U.S. Pat. No. 3,832,449), zeolite ZSM-20 (U.S. Pat. No. 3,972,983), ZSM-23 (U.S. Pat. No. 4,075,842), ZSM-35 (U.S. Pat. No. 4,016,245), ZSM-38 (U.S. Pat. No. 4,046,859), said references herein incorporated by reference.

While any zeolite may be useful to prepare the stain removal compositions stain in accordance with the invention, preferred zeolites include Clinoptilolite, Chabazite, Mordenite, Y, 4A, 5A, P, ZSM-5, Silicalite in which the silica alumina ratio varies between 2 and 600, and mixtures thereof. It is also within the scope of this invention to use calcined zeolites such as 4A, Y, Mordenite, Silicalite and combinations thereof.

Preferably, zeolite is present in the mixture in the form of particles having a diameter less than 2 mm. In a more preferred embodiment, the zeolite particles have a particle size of less than 0.5 mm in diameter. In a still more preferred embodiment, the particle size of the zeolite particles is less than about 0.044 mm in diameter.

Any imide may be useful to prepare the stain removing mixtures of the invention, however, preferred imides include those imides disclosed in U.S. Pat. Nos. 5,833,972 and 5,869,027, incorporated herein by reference. In the most preferred embodiment, the imide is a polyimide selected from the group consisting of polysuccinimide, polyglutarimide, copolymers and terpolymers of polysuccinimide and polyglutarimide, and combinations thereof.

The imide is present in the mixture in an amount up to about 50% by weight of the stain removing mixture is useful in the invention. Preferably, the imide is present in the mixture in an amount ranging from about 0.05% to about 10% by weight of the total mixture. Most preferably, the mixture comprises an imide content of about 0.1% to about 5% by weight of the total mixture.

Zeolite is present in the mixture in an amount ranging from about 50 to about 99.9% by weight based on the total weight of the mixture. Preferably, the amount of zeolite is about 90% to about 99% of the total weight of the mixture.

Stain removing compositions in accordance with the present invention are prepared by mixing at least one zeolite with at least one imide by a conventional mixing process. The stain removing composition may be used in the form of a slurry, a paste, a suspension or a powder. Preferably, compositions of the invention are used in the form of a generally dry, free flowing powder.

The compositions according to the invention may comprise one or more optional constituents including, but are not limited to: buffers and pH adjusting agent, fragrances and deodorizing agent, filler and carriers including inorganic salts, optical brighteners and bleaching constituents, ultraviolet absorbents, antistatics, germicides, preservatives, fillers including talc and naturally occurring or synthetic clays, further scattering and spreading promoters, antisoiling or resoiling inhibitors, chelating agents as well as others constituents known to the art but not elucidated hereinabove. Such constituents as described above include known art compositions, including those described in *McCutcheon's Detergents and Emulsifiers,* North American Edition, 1991: Kirk-Othmer, *Encyclopedia of Chemical Technology,* 33$^{rd}$ Ed., Vol. 22, pp. 346–387.

Such optional constituents may be included in the compositions in an amount which does not undesirably detract from the advantageous features provided by the essential constituents forming the inventive compositions. Preferably, the total weight of such optional constituents is not greater than about 25% of the total weight of the composition, more preferably not greater than about 10% by weight of the total weight of the composition according to the invention.

In accordance with the process of the invention, a stain in a fibrous textile is removed by applying a stain removing formulations according to the invention on the textile in the locus of the stained area either by hand or by means of a suitable appliance. In a preferred embodiment, dried stains are first wetted with water prior to applying the zeolite/imide formulation.

The formulation of the invention is used in an effective stain removing amount. In general the formulations may be used in any quantity sufficient to cover the stain. The stain is contacted with the invention composition for a time sufficient to allow removal of the desired stain, i.e. up to 24 hours or less.

Zeolite/imide compositions in accordance with the invention can be used to remove stains from textile fibers or filaments, either prior to their use, or as used in fabricated fibrous articles such as woven or non-woven fabrics and textiles, rugs, carpets, cloths, mats, screens and the like. The textiles include those made of one or more natural fibers, such as cotton or wool, regenerated natural fibers including regenerated cellulose, and those made of synthetic organic fibers, such as polyamides, polyolefins, polyvinylidene chlorides, acetate, polyacrylics, rayon, and polyester fibers. Blends of two or more such fibrous material are also expressly contemplated.

The formulations of the invention are useful to remove numerous types of stains from fibrous textiles. In particular, the formulations are useful to remove stains associated with animal fluid and solid wastes. Such stains include, but is not limited, animal urine and vomit, e.g., human urine, rabbit urine, gerbil urine, dog urine, cat urine, ferret urine, human vomit, dog vomit, cat vomit and ferret vomit and the like. Other stains for which the invention formulation is useful to remove difficult stains from foodstuffs, such as red dye stains, chocolate stains, mustard stains and the like.

In order to further illustrate the present invention and the advantages thereof, the following examples are given. It is understood that the examples are intended only as illustrative and are not intended to be limiting in nature.

EXAMPLE 1

Removal of Cat Urine Stains

A sick cat urinated on a new sofa with a urethane cushion. The upholstery fabric had been previously treated with a silicone stain guard. The area of the fabric where the cat urinated was misted with water, covered with a mixture of zeolite and imide and allowed to remain until dry. The mixture was vacuumed and the stain was completely removed.

EXAMPLE 2

Dried Puppy Urine on Carpet

A 10 days old urine spot on carpet was lightly misted with water and covered with a zeolite/imide mixture and was allowed to dry. The spot was vacuumed approximately 10 hrs later. The stain was completely gone.

EXAMPLE 3

Preparation of Zeolite/imide Mixture

The following zeolites and imides were mixed in the ratio indicated and then tested for stain removal against cat or dog urine stains. Results are recorded in Table 2 below.

TABLE 2

| zeolite | Imide | ratio* | stain removal |
|---|---|---|---|
| zeolite 4A | polysuccinimide | 1:1 | Yes |
| | | 10:1 | Yes |
| | | 50:1 | Yes |
| Sodalite | polysuccinimide | 50:1 | Yes |
| Faujasite | polysuccinimide | 10:1 | Yes |
| Chabazite | polysuccinimide | 10:1 | Yes |
| | Lysine copolymer of polysuccinimide | 10:1 | Yes |
| Mordenite | polysuccinimide | 50:1 | Yes |
| zeolite Y | polysuccinimide | 50:1 | Yes |
| zeolite P | polysuccinimide | 50:1 | Yes |
| zeolite ZSM-5 | polysuccinimide | 50:1 | Yes |

TABLE 2-continued

| zeolite | Imide | ratio* | stain removal |
|---|---|---|---|
| zeolite 5A | polysuccinimide | 50:1 | Yes |

*ratio = zeolite to imide

EXAMPLE 4

Removal of Human Vomit

A small child vomited on a rug. The solids were removed with a cloth and the remainder was covered with a zeolite/imide mixture. The following day the rug was vacuumed. No stain was visible.

EXAMPLE 5

Particle Size

A sample of natural zeolites from a dust collector were separated into sizes of chips (0.5 to 2 mm diameter), grains (0.044 to 0.5 mm diameter ) and powder particles (less than 0.044 mm diameter). These materials were mixed with an polysuccinimide and then each was tested for stain removal. Stains were removed to a greater degree and more quickly by the powder than by the grains and much quicker yet than by the chips as determined by removal of oil stains. When compared with particle sizes larger than this, it was found that the correlation held that the larger the particle size, the poorer the removal of the stain.

EXAMPLE 6

Removal of Cat Vomit

A cat threw up a fur ball with stomach juices and the stain remained for a period of two years and remained after numerous cleanings by both professional and amateur methods. The stained area was misted with water and a clinoptilolite/polysuccinimide (97.5:2.5) mixture was applied. The area was allowed to dry and then vacuumed. The stain disappeared.

EXAMPLE 7

Cherry Kool-Ade™ Removal

Cherry Kool-Ade™ was spotted on a white cotton towel and a zeolite P/polysuccinimide (97.5:2/5) mixture was placed on the stain and rubbed gently for 15 seconds. The towel was rinsed with water and the stain was gone.

EXAMPLE 8

Removal of Chocolate Syrup

Chocolate Syrup was spotted on a white cotton towel and a zeolite P/polysuccinimide mixture (97.5:2/5) was sprinkled on the stain (sufficient to cover) and rubbed gently for 30 seconds. The towel was rinsed with water and the stain was gone.

EXAMPLE 9

Removal of Mustard Stains

Mustard was spotted on a white cotton towel and a zeolite P/polysuccinimide (97.5:2/5) mixture was sprinkled on the stain (sufficient to cover) and rubbed gently for 30 seconds. The towel was rinsed with water and the stain was significantly reduced.

EXAMPLE 10

Removal of Human Vomit

A 1 year old child spit up its formula on a new clean cotton blouse and a zeolite P/polysuccinimide mixture (97.5:2/5) was applied to the wet spot (completely covered) and after drying the powder was removed. No stain was present.

EXAMPLE 10

Removal of Cherry Soda

A cherry soda was spilled on a white carpet and a clinoptilolite/polysuccinimide mixture (97.5:2/5) was immediately applied (full coverage by sprinkling) and vacuumed 24 hours later. No stain remained.

EXAMPLE 12

Removal of Dog Stains

Dog bedding was covered (by sprinkling from a container having a sifter with holes with a clinoptilolite/polysuccinimide mixture (97.5:2/5) and subsequently washed under normal home laundering conditions. Unlike previous washings where the dog stains remained, this washing returned the bedding to a visibly cleaner appearance by removing the stains left by the dog.

EXAMPLE 13

Removal of Urine

Samples of three blue carpets having nylon, polyester or polyolefin fibers respectively, were stained with human urine. Samples of clinoptilolite, polysuccinimide and a mixture of clinoptilolite/polysuccinimide (97.5:2.5) were applied to each of the urine stained carpets and were allowed to dry overnight. The carpets were then vacuumed and examined for stain at twenty-four hours.

Untreated nylon and polyester showed a greater stain retention than did the polyester fibers. However, all carpets tested had a visible stain retention.

All carpet treated with the polysuccinimide alone retained a significant stain.

Nylon carpet treated with clinoptilolite alone retained a significant stain. Polyester carpet treated with clinoptilolite retained a less significant stain than the nylon carpet. Polyolefin carpet treated with clinoptilolite alone retained only a slight stain.

The urine stain was completely removed by the clinoptilolite/polysuccinimide composition on all carpet fibers tested.

It will be apparent to those skilled in the art that the examples and embodiments described herein are by way of illustration and not of limitation, and that other examples may be utilized without departing from the spirit and scope of the present invention, as set forth in the appended claims.

We claim:

1. A method for removing stains from a fibrous textile comprising applying to a fibrous textile at the locus of a stain an effective stain removing amount of a stain removing composition, wherein said composition comprises a mixture of a zeolite and an imide and wherein said composition is applied to the stain in a dry form.

2. The method of claim 1 further comprising treating the locus of the stain with water prior to applying said stain removing composition.

3. The method of claim 1 wherein the zeolite is selected from the group consisting of Chabazite, Clinoptilolite, Mordenite, zeolite Y, zeolite 4A, zeolite 5A, zeolite P, ZSM-5, Silicalite and mixtures thereof.

4. The method of claim 3, wherein the zeolite is Chabazite.

5. The method of claim 3 wherein the zeolite is zeolite P.

6. The method of claim 3 wherein said zeolite is zeolite 4A.

7. The method of claim 3 wherein said zeolite is Clinoptilolite.

8. The method of claim 1 wherein said zeolite has a particle size of less than 0.5 mm diameter.

9. The method of claim 1 wherein said zeolite has a particle size of less than 0.1 mm diameter.

10. The method of claim 9 wherein said zeolite has a particle size of less than 0.044 mm diameter.

11. The method of claim 1 wherein the imide is a polyimide.

12. The method of claim 11 wherein the polyimide is selected from the group consisting of polysuccinimide, copolymers of polysuccinimide, terpolymers of polysuccinimide, polyglutarimide, copolymer of polyglutarimide, terpolymers of polyglutarimide, and mixtures thereof.

13. The method of claim 12 wherein said polyimide is polysuccinimide.

14. The method of claim 12 wherein said polyimide is a copolymer of polysuccinimide.

15. The method of claim 1 wherein the stain to be removed is urine.

16. The method of claim 15 wherein said urine is selected from the group consisting of human urine, rabbit urine, gerbil urine, dog urine, cat urine, ferret urine or a combination thereof.

17. The method of claim 1 wherein the stain to be removed is vomit.

18. The method of claim 17 wherein said vomit is selected from the group consisting human vomit, dog vomit, cat vomit and ferret vomit.

19. The method of claim 1 wherein the stain to be removed is food.

20. The method of claim 1 wherein the fibrous textile is selected from the group consisting of textile fibers, filaments, fabrics, rugs, carpets, cloths, mats, screens and towels.

* * * * *